US011009280B1

(12) United States Patent
Bergida et al.

(10) Patent No.: US 11,009,280 B1
(45) Date of Patent: May 18, 2021

(54) INSULATED COLD PACK

(71) Applicant: FROSTY COLD, LLC, Overland Park, KS (US)

(72) Inventors: John R. Bergida, Wildwood, MO (US); Timothy B. Jackson, Chesterfield, MO (US); David D. Leavitt, Shawnee, KS (US)

(73) Assignee: FROSTY COLD, LLC, Overland Park, KS (US)

( * ) Notice: Subject to any disclaimer, the term of this patent is extended or adjusted under 35 U.S.C. 154(b) by 0 days.

(21) Appl. No.: 16/805,954

(22) Filed: Mar. 2, 2020

(51) Int. Cl.
*F25D 3/00* (2006.01)
*F25D 5/02* (2006.01)

(52) U.S. Cl.
CPC ..... *F25D 5/02* (2013.01)

(58) Field of Classification Search
CPC ..... F25D 2303/08; F25D 2303/082; F25D 2303/0822; F25D 2303/085; F25D 2303/0841; F25D 2331/801; F25D 2331/8015; F25D 5/02; F25D 3/00; F25D 2201/122; F25D 2303/0843; A61F 2007/108; A61F 2007/0249; B65D 81/18
USPC ..... 62/530, 371, 529
See application file for complete search history.

(56) References Cited

U.S. PATENT DOCUMENTS 4,596,250 A * 6/1986 Beisang, III ..... A61F 7/02 607/114
2008/0107849 A1* 5/2008 Gano ..... B65D 65/466 428/35.7
2013/0261712 A1* 10/2013 Ebel ..... A61F 7/10 607/112

FOREIGN PATENT DOCUMENTS

WO WO2017/186965 * 2/2017 ..... A61F 7/02

* cited by examiner

*Primary Examiner* — Cassey D Bauer
(74) *Attorney, Agent, or Firm* — Lathrop GPM LLP

(57) ABSTRACT

An insulated cold pack for cooling a product, the cold pack including a viscous cooling agent that may serve as a plant fertilizer when discarded. The cooling agent encapsulated in at least one sealed flexible walled package, the one or more flexible walled packages located on the first side of the insulated cold pack. In addition, the cold pack includes biodegradable loose-fill insulation covering the second side of the insulated cold pack. An encapsulating barrier surrounds both the viscous cooling agent on the first side of the insulated cold pack as well as the loose-fill insulation on the second side. The loose-fill insulation secured in position within the encapsulating barrier and the insulation positioned in contact with the product or optionally closely spaced from the product to be cooled.

29 Claims, 5 Drawing Sheets

INSULATED COLD PACK

TECHNICAL FIELD

This disclosure relates to an insulated cold pack for use in cooling a product.

BACKGROUND

A phase change material is a substance which releases/absorbs sufficient energy at phase transition to provide useful heat/cooling. Generally, the transition will be from one of the first two fundamental states of matter—solid and liquid—to the other. The energy released/absorbed by phase transition from solid to liquid, or vice-versa, the heat of fusion is generally much higher than the sensible heat. Ice, for example, requires 333.55 J/g to melt, but then water will rise one degree further with the addition of just 4.18 J/g. Water/ice is therefore a very useful phase change material and has been used to store winter cold to cool buildings in summer for centuries.

Desirable phase change materials should possess the following properties: (1) Melting temperature in the desired operating temperature range; (2) High latent heat of fusion per unit volume; (3) High specific heat, high density, and high thermal conductivity; (4) Small volume changes on phase transformation and small vapor pressure at operating temperatures to reduce the containment problem; (4) Congruent melting; (5) Kinetic properties (6) High nucleation rate to avoid supercooling of the liquid phase; (7) High rate of crystal growth, so that the system can meet demands of heat recovery from the storage system; (8) Chemical properties; (9) Chemical stability; (10) Complete reversible freeze/melt cycle; (11) No degradation after a large number of freeze/melt cycles; (12) Non-corrosiveness, non-toxic, non-flammable and non-explosive materials; (13) Economic properties; (14) Low cost; and (15) Availability.

SUMMARY

The insulated cold pack as disclosed herein is intended to cool a product such as one in transit between locations over the course of many hours or even days when powered cooling capacity, such as a refrigeration system is unavailable. The disclosed cooling pack includes a viscous cooling agent, preferably in the form of a gel, that upon appropriate land disposal can serve as a plant fertilizer following decomposition of the encapsulating materials and exposure to the environment of the contents of the insulated cold pack 10. The viscous cooling agent is a phase change material that can provide an extended transfer of heat away from the object or substance to be cooled. The phase change materials selected have high latent heats of fusion and maintain relatively constant temperatures as they change phase. This permits light weight packaging with the maintenance of temperatures in narrow, preselected ranges over extended periods of time.

The cooling agent phase change material is encapsulated in at least one sealed flexible walled package. The flexible walled encapsulation material is preferably biodegradable to facilitate decomposition of the encapsulation material and the contents of the entire insulated cold pack when exposed to the appropriate environmental conditions. The cold pack also utilizes biodegradable loose-fill packaging material. Lastly, an encapsulating barrier is employed to restrain in position the one or more flexible walled package of viscous cooling agent and the adjacent biodegradable loose-fill packaging material.

Various objects, features, aspects and advantages of the disclosed subject matter will become more apparent from the following detailed description of preferred embodiments, along with the accompanying drawings in which like numerals represent like components. The contents of this summary section are provided only as a simplified introduction to the disclosure, and are not intended to be used to limit the scope of the appended claims.

The contents of this summary section are provided only as a simplified introduction to the disclosure, and are not intended to be used to limit the scope of the appended claims.

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

Initially, solid-liquid phase change materials behave like sensible heat storage materials; their temperature rises as they absorb heat. Unlike conventional sensible heat storage materials, however, when phase change materials reach their phase change temperature (their melting point) they absorb large amounts of heat at an almost constant temperature until all the material is melted. Within the human comfort range between 20–30° C., some phase change materials are very effective, storing over 200 kJ/kg of latent heat. This heat storage capacity of specified phase changer materials has proven very beneficial in the development of the insulated cold pack disclosed herein.

Figure 1:
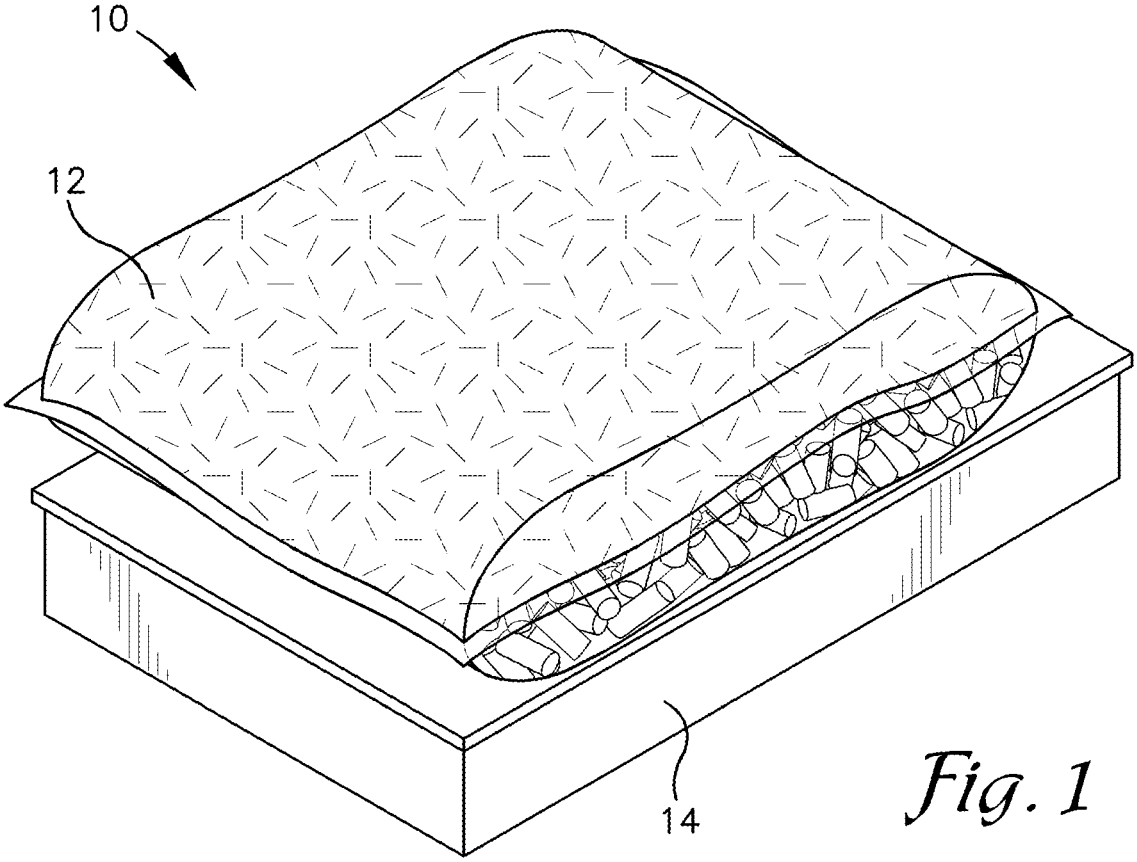
FIG. 1 depicts an embodiment of a cold pack adjacent a product requiring cooling.

The insulated cold pack 10 as shown in FIG. 1 is comprised of a viscous cooling agent 12 that is preferably a phase change material used to remove thermal energy from the product 14 that is being cooled. The produce in this case may be bottles of wine, chocolates, pharmaceuticals or high-quality cuts of meat, for example, all of which are undergoing shipment by a third-party vendor to a distant location that requires prolonged passive cooling capacity, but not too much capacity where it may result in freezer burn to products such as meat. Equally as important, the insulated cold pack 10 as disclosed herein must be able to moderate the transfer of thermal energy from the product 14 to the cold pack so that the duration of cooling is sufficiently prolonged to accommodate long distance shipping of the product that may require several days at temperatures that challenge the operational capabilities of prior art cold packs.

The cooling agent 12 is also specifically formulated to serve as a plant fertilizer that contains one or more of nitrogen, phosphorus and potassium that may include an equally balanced blend, e.g., each at 20% of the overall composition of the cooling agent mass; or optionally a blend that has a higher nitrogen concentration than the other nutrients. The availability of high plant nutrient content along with the biodegradable aspect of other components of the insulated cold pack 10 support land disposal of the pack in an environmentally conscious manner.

The cooling agent 12 as a phase change material are substances that absorb and release thermal energy during the process of melting and freezing. When a phase change materials freezes, it releases a large amount of energy in the form of latent heat at a relatively constant temperature. Conversely, when phase change materials melt, they absorb a large amount of heat from the environment. Phase change materials recharge as ambient temperatures fluctuate above and below the phase change temperatures, making them ideal for a variety of everyday applications that require temperature control.

The most commonly used phase change material is water/ice. Ice is an excellent phase change material for maintaining temperatures at 0° C. But water's freezing point is fixed at 0° C. (32° F.), which makes it unsuitable for most thermal energy storage applications. To address that limitation, phase change materials have been developed for use across a broad range of temperatures, from −40° C. to more than 150° C. They typically store 5 to 14 times more heat per unit volume than materials such as water, masonry or rock. Among various heat storage options, phase change materials are particularly attractive because they offer high-density energy storage and store heat within a narrow temperature range.

There are two kinds of heat energy: sensible and latent. Most common heat storage systems, such as a conventional water heater, use sensible heat, the energy needed to alter the temperature of a substance with no phase change. Latent heat, which can be 100 times that of sensible heat, is the amount of energy required to change matter from one state to another, liquid to solid or vice versa. Sensible heat and latent heat work together in thermal storage materials and result in the ability to maintain specific temperatures for extended periods of time.

The gel cooling agent 12 in many cooling applications may optionally be comprised of eutectic mixtures and salt hydrates. A eutectic mixture is defined as a mixture of two or more components which usually do not interact to form a new chemical compound but, which at certain ratios, inhibit the crystallization process of one another resulting in a system having a lower melting point than either of the components.

Some examples of a eutectic mixture are sodium chloride and water which form a eutectic mixture whose eutectic point is −21.2° C. and 23.3% salt by mass. The eutectic nature of salt and water is exploited when salt is spread on roads to aid snow removal, or mixed with ice to produce low temperatures (for example, in traditional ice cream making). Another example is ethanol-water has an unusually biased eutectic point, i.e., it is close to pure ethanol, which sets the maximum proof obtainable by fractional freezing. A third example is "Solar salt", 60% $NaNO_3$ and 40% $KNO_3$, which forms a eutectic molten salt mixture which is used for thermal energy storage in concentrated solar power plants. To reduce the eutectic melting point in the solar molten salts, calcium nitrate is used in the following proportion: 42% $Ca(NO_3)_2$, 43% $KNO_3$, and 15% $NaNO_3$. A fourth alternative is Lidocaine and prilocaine—both are solids at room temperature—form a eutectic that is an oil with a 16° C. (61° F.) melting point that is used in eutectic mixture of local anesthetic (EMLA) preparations. Lastly, menthol and camphor, both solids at room temperature, form a eutectic that is a liquid at room temperature in the following proportions: 8:2, 7:3, 6:4 and 5:5.

Salt hydrates comprise an important group of phase change materials. An inorganic salt hydrate (hydrated salt or hydrate) is an ionic compound in which many water molecules are attracted by the ions and therefore enclosed within its crystal lattice. The general formula of a hydrated salt is $M_xN_y.nH_2O$. The water molecules inside the crystals of a hydrate mostly coordinate covalent bonds and hydrogen bonds to the positively charged metal ions (cations) of the salt. These water molecules may be referred to as water of crystallization or water of hydration.

During heating, hydrated salt loses its water of crystallization by absorbing a certain amount of energy, called the enthalpy of dehydration ($\Delta H_{dehyd}$). While cooling or being exposed to the atmosphere, water molecules from the surroundings are easily captured by salt crystals and release the thermal energy corresponding to $\Delta H_{hyd}$. The dehydration and hydration processes are like melting and freezing thermodynamically.

Various formulations of the cooling agent 12 may be used, e.g., water with additives, food grade cellulose gum (carboxyl methyl cellulose; CMC), food grade propylene glycol or salt (e.g. to help prevent freezing), superabsorbers (poly acrylamites), gelatin, starch or other thickening agents, etc., with preservatives such as benzoic acid possibly being included. The cooling agent is useful for temporarily cooling materials and are preferably reusable but readily disposable and fully biodegradable. The cooling agents can be chilled (e.g., frozen) to cool a product for a period and can be re-chilled, e.g., after the chilling effects are no longer needed or the temperature of the insulated cold pack has stabilized to the ambient surrounding temperature, or the packs have had a phase transition from a solid to a liquid state.

The cooling agent 12 preferably has a viscosity in the range of about 50,000 to 70,000 centipoises and is resistant to flow. Laminar flow is characterized by the smooth flow of the fluid in layers that do not mix. Turbulent flow, or turbulence, is characterized by eddies and swirls that mix layers of fluid together. Layers flow without mixing when flow is laminar. When there is turbulence, the layers mix, and there are significant velocities in directions other than the overall direction of flow. Laminar flow occurs in layers without mixing and high viscosity causes drag between layers as well as with the fixed surface of the fluid container.

The objective of the cooling agent 12 within the insulated cold pack 10 disclosed herein is to maximize cooling effect both in temperature maintenance and cooling duration. The high viscosity fluid does not mix well, even during periods of agitation such as while in transit. The lack of mixing of the cooling agent 12 due to the high viscosity, results in prolonged maintenance of temperature which is a desired characteristic of the insulated cold pack. Test results have revealed that the high viscosity cooling agent disclosed herein facilitates temperature maintenance for a longer duration than a low viscosity cooling agent similarly situated.

Figure 2:
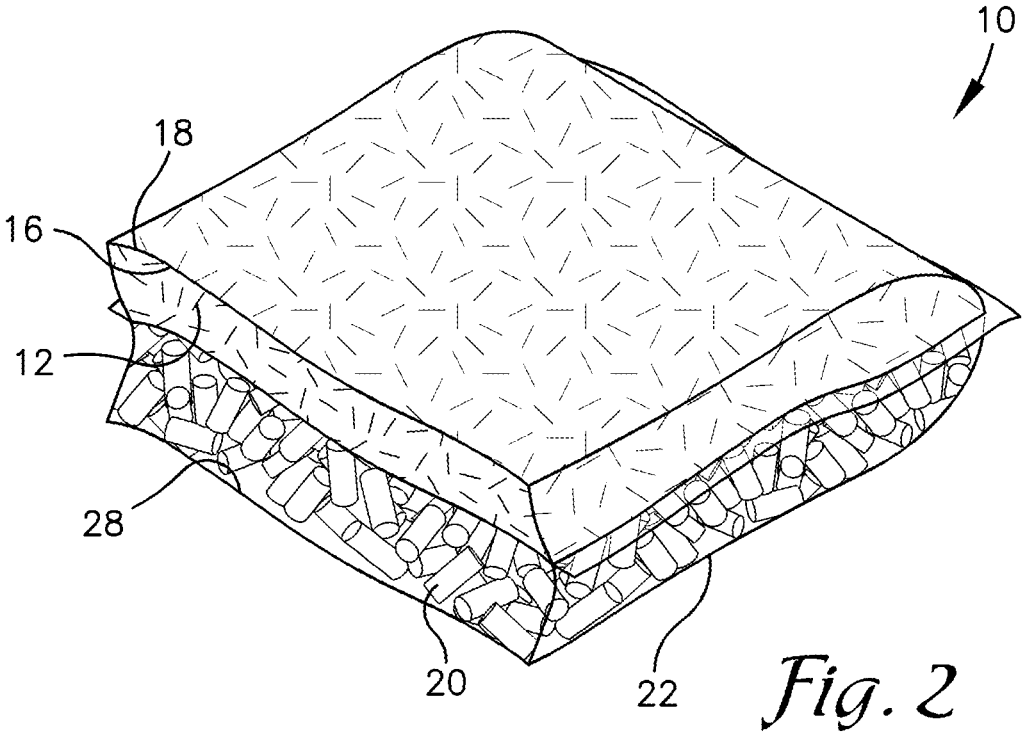
FIG. 2 illustrates an embodiment of a cold pack providing additional detail on the construction of the cold pack.

As seen in FIG. 2, the cooling agent 12 is encapsulated in one or more sealed flexible walled packages 16 and forms the first side 18 of the insulated cold pack 10. The flexible walled container material 16 housing the cooling agent 12 is biodegradable/compostable and may be comprised of for example, kraft paper with a plant-based PLA lining, polypropylene, polyhydroxyalkanoates (PHA), poly-3-hydroxybutyrate (PHB), polyhydroxyvalerate (PHV) and polyhydroxygexanoate (PHH), lignin-based polymer composites, polyglycolic acid (PGA), polybutylene succinate (PBS), polycaprolactone (PCL), poly(vinyl alcohol) (PVA, PCOH) or polybutylene adipate terephthalate (PBAT). In addition, plastics that have conformed to an established national standard for home compostability include BioPBS FD92 resin with a maximum thickness of 85 microns, BWC BF 90A resin with a maximum thickness of 81 microns, Ecopond Flex 162 resin with a maximum thickness of 65 microns, HCPT-1 triple laminate with a maximum thickness of 119 microns, HCFD-2 duplex laminate with a maximum thickness of 69 microns and Torise TRBF90 resin with a maximum thickness of 43 microns.

The above referenced container material 16 options are also capable of satisfactory compliance with ASTM F392/F392M—11(2015) titled "Standard Practice for Conditioning Flexible Barrier Materials for Flex Durability." The compostable/biodegradable material must be resistant to flex-formed pinhole failures. In addition, the insulated cold pack 10 disclosed herein is capable of providing cushioning for the product 14 that is being cooled. The insulated cold pack 10 preferably complies with ASTM D1596-14 titled "Standard Test Method for Dynamic Shock Cushioning Characteristic of Packaging Material."

The preferred plastics are compostable plastics or biodegradable plastics that break down into their organic constituents. Composting typically takes place in aerobic environments, while biodegradation may take place in anaerobic environments. That is, biologically-based polymers, sourced from non-fossil materials, decompose naturally in the environment. Whereas some bioplastics, made of biologically degradable polymers, require the assistance of anaerobic digesters or composting units to break down synthetic material during organic recycling processes.

Plastic lined kraft paper with a thickness preferably in the range of about 0.004 and 0.009 inches is appropriate so that upon land disposal, and exposure to weathering, sunlight and biological activity the entire cold pack 10, to include the plastic lined kraft paper, will degrade and serve as an amendment to the soil. Plastic-coated paper is a coated or laminated composite material made of paper or paperboard with a plastic layer or treatment on a surface. This type of coated paper is commonly used in the food and drink packaging industry because of the paper's capacity for water resistance, tear strength, abrasion resistance, and it also possesses the ability to be heat sealed which is an attribute contemplated by the insulated cold pack 10 disclosed herein.

The cold pack 10 disclosed herein, when disposed of on soil, will begin decomposition within at most a few months and upon decomposition, should the cooling agent 12 contents not be released upon abandonment, i.e., rupturing of the flex walled package 16 to release the cooling agent 12 onto the soil, the cooling agent 12 will ultimately escape to the soil upon decomposition of the flexible walled container 16. Once the cooling agent 12 is released into the soil it will serve, as detailed above, as a soil nutrient.

In a first embodiment, the insulated cold pack 10 utilizes biodegradable loose-fill packaging material 20 covering the second side 22 of the insulated cold pack 10 and housed within a separate biodegradable container 28. The loose-fill packaging material 20 is preferably fabricated from corn or wheat starch. A preferred configuration of the loose-fill packaging material is packing peanuts which are commonly used to protect fragile items such as dishware and glassware and are appropriately functional in this instance; however, other types of loose-fill packaging, such as coconut husks, sphagnum peat moss, shredded paper, cotton, shredded denim, straw, sawdust, hemp and wool, for example, are also contemplated with this disclosure and are biodegradable/compostable. It is also contemplated that granular loose-fill packaging 20, with the consistency of sand or pea gravel, may also be employed to provide the desired insulative effect.

In an alternative embodiment, instead of the insulated cold pack 10 utilizing loose-fill packaging material 20, a sheet, or panel, of insulating material may also be employed to retard the heat flux between the object being cooled and the cold pack 10. The sheet is preferably comprised of biodegradable material such as corn or wheat starch and provides an insulative or heat flux retarding component to the cold pack 10.

The loose-fill packaging 20 of the first embodiment or in the alternative the sheet or panel of insulating material of the second embodiment are positioned on the second side 22 of the insulated cold pack 10, opposite the first side 18. Depending upon the specific cooling application for the insulated cold pack 10, the second side has a loose-fill packaging 20 thickness between about 0.25 and 0.75 inches. Typical loose-fill packaging insulation material 20 has an R-value of about 4.0 per inch which translates into an R-value of between 1 and 3 for the thickness disclosed herein. R-value is defined as the temperature difference per unit of heat flux needed to sustain one unit of heat flux between the warmer surface and colder surface of a barrier under steady-state conditions.

The lower end of this thickness range of the loose-fill packaging 20 facilitates the transfer of heat from the product 14 to the insulated cold pack 10, relative to the greater thickness, yet maintains a barrier to prevent freezer burn and serves to moderate the thermal energy transfer to a pace that is consistent with the available capacity of the insulated cold pack to absorb the heat from the product 14 sought to be cooled. The upper end of the loose-fill insulation 20 thickness at about 0.75 inches provides a more robust barrier to the transfer of heat thereby providing less cooling capacity to the product but provides a longer duration of cooling at a lower heat flux between the product 14 and the cooling agent 12.

Set forth below are three graphs detailing the results of experimentation on the cooling efficacy of cold packs with insulation levels at 50%, 75% and 100%. The percentage of loose-fill insulation 20 is directly related to the thickness of insulation that is applied to the cold pack 10. As detailed above, the maximum thickness of loose-fill insulation 20 that is employed is about 0.75 inches and the minimum is about 0.25 inches. Therefore, the thicknesses of insulation that were employed in the experiments leading to the data in the graphs shown below are 0.25 inches (50%), 0.50 inches (75%) and 0.75 inches (100%).

Loose-fill insulation 20 thicknesses less than 0.25 inches (50%) resulted in an undesirably accelerated rate of thermal transfer from the product 14 to the cold pack 10 and a shortened duration of cooling efficacy. This shortened period of cooling efficacy could result in the product 14, e.g., wine, experiencing a temperature level below the permissible minimum and potentially being detrimental to product quality. Likewise, a loose-fill insulation 20 thickness that is too thin may also result in such an accelerated rate of heat flux that there is insufficient capacity in the cooling agent 12 to continue to cool the product 14 for the desired duration.

Figure 3:
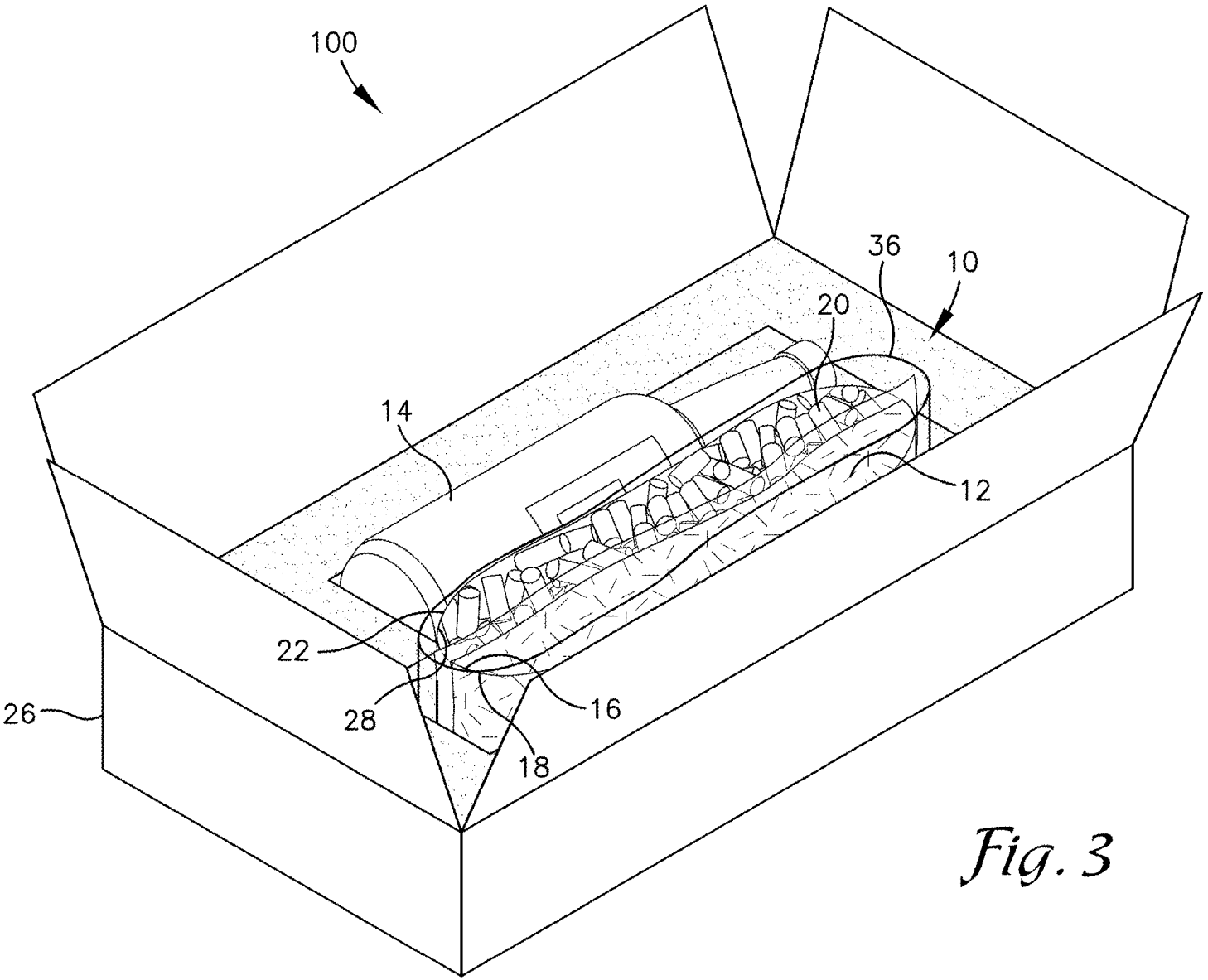
FIG. 3 illustrates an embodiment of a cold pack disposed adjacent a product requiring cooling within a container.

A thickness greater than 0.75 inches (100%) results in an insufficient thermal transfer from the cold pack 10 to the product 14 and the temperature of the product 14 rises too quickly above the upper bound (46.4° F.) resulting in potential harm to the product 14. Increasing thickness of the insulation 20 excessively can retard the thermal transfer from the product 14 to the cold pack 10 thereby negating the functionality of the cold pack 10. Consequently, it is imperative that the thickness of the insulation in a cold pack be carefully evaluated prior to the application of the cold pack 10 to the product 14 to be cooled. As seen in FIG. 3, the cold pack system requires that the thermal resistance of the container 26 that is housing the product 14 and cold pack 10 also be evaluated. A container 26 that is highly resistant to thermal energy transfer will reduce the need for a more robust cold pack system as thermal energy will be less able to enter the interior space of the container 26.

Figure 4:
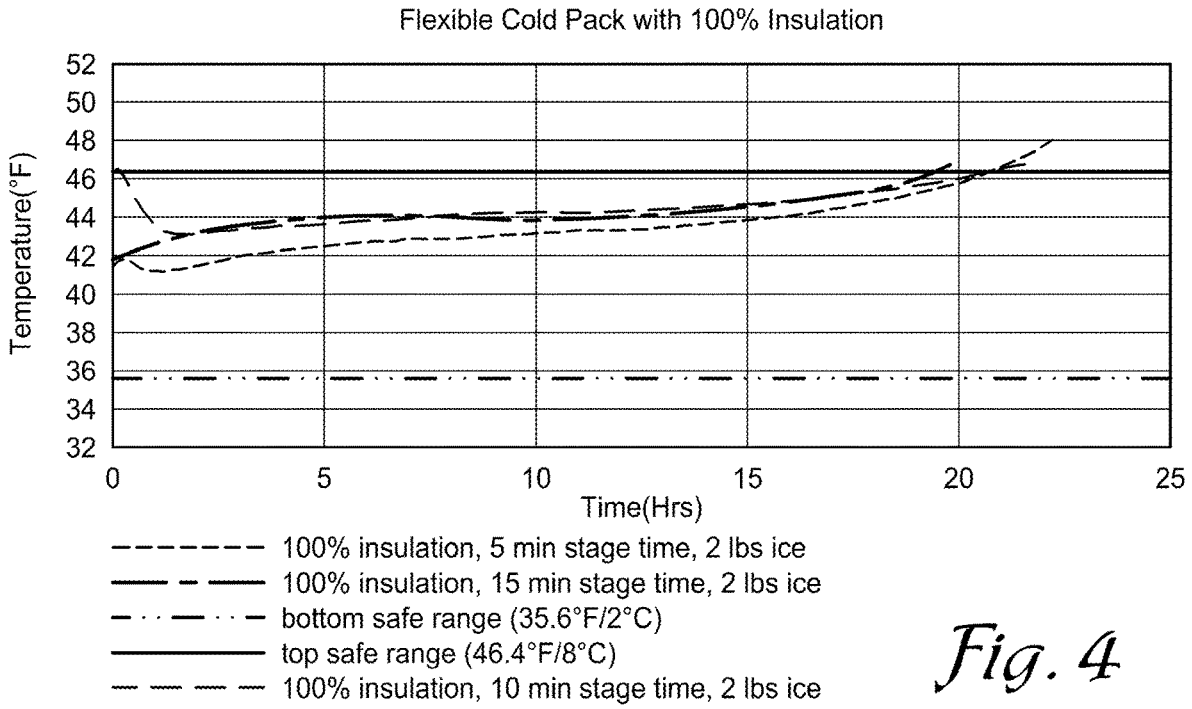
FIG. 4 provides a graphical representation of an insulated cold pack with 100% insulation and the upper and lower temperature limits associated with the warmest and coolest temperatures during passive cooling of a product.
Figure 5:
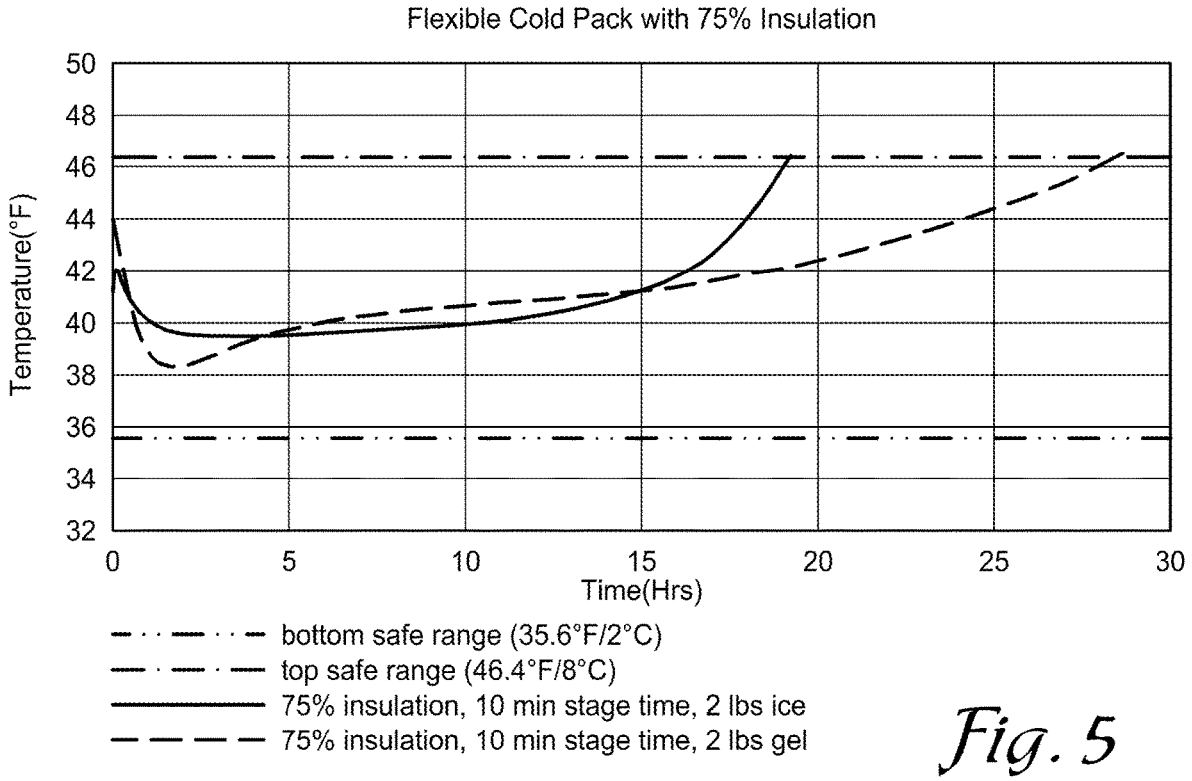
FIG. 5 provides a graphical representation of an insulated cold pack with 75% insulation and the upper and lower temperature limits associated with the warmest and coolest temperatures during passive cooling of a product.
Figure 6:
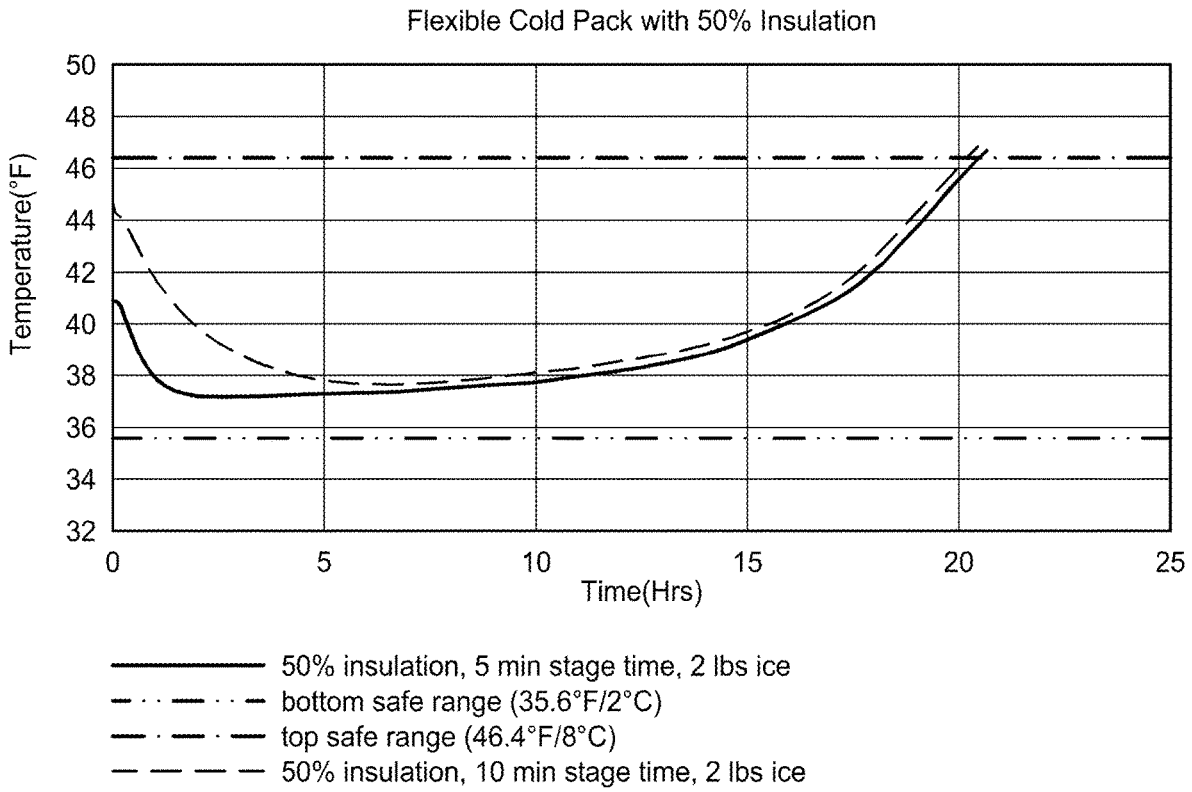
FIG. 6 provides a graphical representation of an insulated cold pack with 50% insulation and the upper and lower temperature limits associated with the warmest and coolest temperatures during passive cooling of a product.

FIGS. 4-6 include upper and lower temperature limits of 46.4° F. and a lower limit of 35.6° F. These temperature bounds are associated with the warmest and coolest temperatures that most products 14 should be subjected to while undergoing passive cooling, such as with the insulated cold pack 10. In addition, FIGS. 4-6 also detail various "staging times." The staging times represent intervals of time that the insulated cold pack 10 is removed from the environment where the cold pack 10 is being actively cooled, i.e., in a refrigerator, and allowed to warm before being placed in an environment for passive cooling of a product. All three of FIGS. 4-6 reveal that no matter the percentage of insulation, the cooling efficacy duration is in the range of about 20 hours. With 75% insulation and a viscous cooling agent gel, as opposed to ice, the cooling duration is extended to over 25 hours.

The viscous gel cooling agent 12 encapsulated in one or more sealed flexible walled containers 16 forming the first side 18 of the insulated cold pack 10 is conjoined with the loose fill-packaging 20 on the second side 22. The loose-fill packaging is sealed in a second flexible walled container 28. The first flexible walled container 16 and the second flexible walled container 28 are both packaged within a third fully surrounding encapsulating barrier 36. The second flexible walled container 28 and encapsulating barrier 36 are also biodegradable so that upon land disposal, and exposure to weathering, sunlight and biological activity, they will undergo decomposition within at most a few months and upon decomposition, should the cooling agent 12 contents and loose-fill packaging 20 not be immediately released to the environment upon abandonment of the insulated cold pack 10, the cooling agent 12 as detailed above will ultimately escape to the soil upon decomposition of the second flexible walled container 28 and encapsulating barrier 36. In addition, the loose-fill packaging 20 also being biodegradable once released onto the soil and with exposure to moisture will rapidly decompose and provide supplemental nutrients to the soil.

In a preferred embodiment of the disclosed insulated cold pack 10, the biodegradable/compostable containers/encapsulating barriers 16, 28, 36 are fabricated from a sheet of plastic lined kraft paper that is folded over onto itself with the plastic lining portion on the interior. Next, the two edges adjacent the folded edge are heat sealed to one another creating a pocket into which either the insulating material 20 or the cooling agent 12 is deposited. The remaining edge is then heat sealed to enclose the deposited material into position. In this preferred embodiment, the plastic lined kraft paper serves in the capacity of the biodegradable/compostable flex walled packaging 16, the container 28 and the encapsulating barrier 36 that is resistant to leaking at the heat sealed edges and permeation of the cooling agent.

As previously detailed, the plastic lined kraft paper is particularly appropriate in this disclosed cold pack 10 due to the compostability and biodegradability of the paper. Moreover, the plastic lined kraft paper has the requisite resistance to tearing and puncture and is capable of providing cushioning against shock consistent with the criteria set forth at ASTM F392/F392M—11(2015) and D1596-14 as previously detailed above.

Figure 2A:
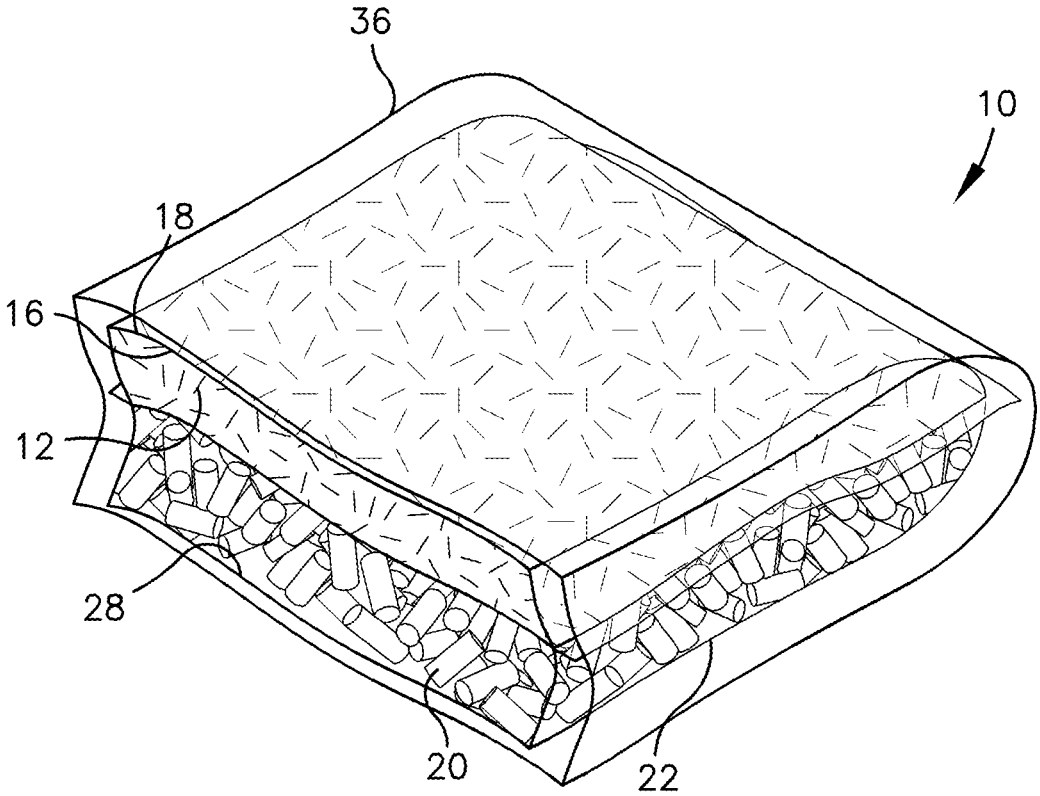
FIG. 2A illustrates an embodiment of a cold pack providing additional detail on the construction of the cold pack.

In operation an appropriately sized insulated cold pack 10 is selected for cooling the product 14, for example, a bottle of wine 14 as depicted in FIG. 3. The sizing process contemplates the temperature extremes to be experienced by the product 14 as it is shipped in the container 26. Long shipping durations with exposure to high temperatures may require a more heavily insulated container 26, increased volume of the insulated cold packs 10 disclosed herein along with a rationalized selection of the required thickness of the loose-fill packaging material 20 to provide the desired rate of cooling along with the ability to conform the second side 22 of the insulated cold pack to the product 14. The assessment of the desired volume of plant nutrient cooling agent 12, along with the type and thickness of loose fill insulation 20 are also variables requiring discernment that are contemplated by the disclosure herein. Critically, all materials utilized in the insulated cold pack 10 are to be readily biodegradable to include the viscous gel cooling agent 12 serving as a fertilizer, the loose-fill packaging material 20 and the flexible thin walled encapsulating materials 16, 28 and encapsulating barrier 36 as illustrated at FIGS. 2A and 3.

The disclosed system 100 includes not only the insulated cold pack 10 but also the product 14 to be cooled and the container 26 into which the product 14 and cold pack 10 are to be placed. The container 26 may be fabricated from a wide array of materials to include Styrofoam, cardboard, plastics and composites, among others.

The second side 22, containing the loose-fill packaging material 20, of the insulated cold pack 10 is positioned either in contact with, or less preferably, is closely spaced from the product 14. Even if the second side 22 of the cold pack 10 is not in direct contact with the product, but is closely spaced from it, the cold pack 10 heat will still be transferred from the product 14 to the cold pack 10 albeit with a lesser heat flux.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings. Moreover, the order of the components detailed in the system may be modified without limiting the scope of the disclosure.

We claim:

1. An insulated cold pack for cooling a product, the cold pack comprising, (a) a viscous cooling agent, the cooling agent encapsulated in at least one sealed flexible walled package and disposed on the first side of the insulated cold pack;

(b) a loose-fill packaging material covering the second side of the insulated cold pack; and (c) an encapsulating barrier surrounding the at least one flexible walled package of the viscous cooling agent on the first side of the insulated cold pack and the loose-fill packaging material covering the second side of the insulated cold pack; wherein the at least one sealed flexible walled package of viscous cooling agent is disposed adjacent the loose-fill packaging material with both the cooling agent and loose-fill packaging material secured in position within the encapsulating barrier and the encapsulating barrier on the second side of the insulated cold pack capable of being positioned in contact with the product or closely spaced from the product.

2. The insulated cold pack of claim 1, wherein the loose-filled packaging material is biodegradable and comprised of corn starch or wheat starch.

3. The insulated cold pack of claim 1, wherein the biodegradable loose-filled packaging material forms a layer thickness that is substantially consistent across the insulated cold pack and has a thickness in the range of about 0.25 to 0.75 inches.

4. The insulated cold pack of claim 1, wherein the at least one sealed flexible walled package is at least one of compostable and bio-degradable.

5. The insulated cold pack of claim 1, wherein the encapsulating barrier is at least one of compostable and bio-degradable.

6. The insulated cold pack of claim 1, wherein the viscous cooling agent is a salt hydrate.

7. The insulated cold pack of claim 1, wherein the viscous cooling agent plant fertilizer further comprises primarily nitrogen, phosphorus and potassium.

8. The insulated cold pack of claim 7, wherein the ratio of nitrogen to phosphorus to potassium is 1:1:1.

9. The insulated cold pack of claim 1, wherein the viscous cooling agent has a viscosity in the range of about 50,000 to 70,000 centipoises.

10. The insulated cold pack of claim 1, wherein the viscous cooling agent is a phase change material with latent heat storage potential of at least 200 kJ/kg.

11. The insulated cold pack of claim 1, wherein the viscous cooling agent is comprised of 50 parts ammonia-nitrate, 40 parts urea, 4 parts potassium-nitrate, 5 parts ammonium-polyphosphate and around 1-part guar gum.

12. A method for passively controlling the transfer of heat from a product, the method comprising:

selecting an insulated cold pack with a first side and a second side, the cold pack comprising:

(a) a viscous cooling agent, the cooling agent encapsulated in at least one sealed flexible walled package and disposed on the first side of the insulated cold pack;

(b) a loose-fill packaging material covering the second side of the insulated cold pack; and (c) an encapsulating barrier surrounding the at least one flexible walled package of the viscous cooling agent on the first side of the insulated cold pack and the loose-fill packaging material covering the second side of the insulated cold pack;

lowering the temperature of the insulated cold pack to no greater than the liquid-to-solid phase change temperature of the cooling agent;

positioning the second side of the insulated cold pack against or closely spaced from the product; and configuring the loose-fill packaging material to conform to the desired shape of the product.

13. The method for passively controlling the transfer of heat of claim 12, wherein the configuring step comprises compressing the loose-fill packaging against the material to optimize heat transfer from the product to the insulating cold pack.

14. The method for passively controlling the transfer of heat of claim 12, wherein the encapsulating barrier surrounding the flexible walled package of the viscous cooling agent and the biodegradable loose-fill packaging material is at least one of compostable and biodegradable.

15. The method for passively controlling the transfer of heat of claim 12, wherein the viscous cooling agent is a compound of at least one of nitrogen, potassium and phosphorus nutrients.

16. A system for passively retarding the increase in temperature of a product, the system comprising:

a container for housing the product;

an insulated cold pack comprising:

(a) a viscous cooling agent, the cooling agent encapsulated in at least one sealed flexible walled package and disposed on the first side of the insulated cold pack;

(b) a loose-fill packaging material covering the second side of the insulated cold pack; and (c) an encapsulating barrier surrounding the at least one flexible walled package of the viscous cooling agent on the first side of the insulated cold pack and the loose-fill packaging material covering the second side of the insulated cold pack; wherein the product is disposed within the container and the second side of the insulated cold pack is capable of being positioned in contact with or, closely spaced from, the product to effectuate the transfer of heat from the product to the insulated cold pack.

17. The system for passively retarding the increase in temperature of the product of claim 16, wherein the loose-fill packaging material covering the second side of the insulated cold pack forms a layer.

18. The system for passively retarding the increase in temperature of the product of claim 17, wherein the thickness of the packaging material layer is in the range of about 0.25 to 0.75 inches.

19. The system for passively retarding the increase in temperature of the product of claim 16, wherein the packaging material layer moderates the transfer of heat from the product to the insulated cold pack.

20. The system for passively retarding the increase in temperature of the product of claim 17, wherein the moderation of heat transfer by the packaging material layer reduces the potential for undesirable localized transfer of heat.

21. The system for passively retarding the increase in temperature of the product of claim 16, wherein the packaging material layer is conformed to the shape of the product prior to being placed in contact with, or closely spaced from, the product.

22. The system for passively retarding the increase in temperature of the product of claim 16, wherein the viscous cooling agent is a plant fertilizer.

23. The system for passively retarding the increase in temperature of the product of claim 16, wherein the loose-fill packaging material is biodegradable.

24. An insulated cold pack for cooling a product, the cold pack comprising, (a) a viscous cooling agent, the cooling agent encapsulated in a first sealed flexible walled package, the cooling agent comprising the first side of the insulated cold pack;

(b) a sheet of insulating material encapsulated in a second sealed flexible walled package, the insulating material disposed adjacent the first side of the insulated cold pack and forming the second side of the cold pack; and (c) an encapsulating barrier surrounding both the flexible walled package of the viscous cooling agent on the first side of the insulated cold pack and the second sealed sheet of insulating material, the encapsulating barrier comprised of Ecopond Flex 162 resin with a barrier thickness of 65 microns.

25. The insulated cold pack for cooling a product of claim 24, wherein the viscous cooling agent is at least one of (a) biodegradable, and (b) compostable.

26. The insulated cold pack for cooling a product of claim 24, wherein the sheet of insulating material is at least one of (a) biodegradable, and (b) compostable.

27. The insulated cold pack for cooling a product of claim 24, wherein the encapsulating barrier or viscous cooling agent is at least one of (a) biodegradable, and (b) compostable.

28. The insulated cold pack for cooling a product of claim 24, wherein the sheet of insulating material has an R value in the range of about 1 to 3.

29. The insulated cold pack for cooling a product of claim 24, wherein the first and second sealed flexible walled packages are comprised of kraft paper with a plastic lining on at least one side.

* * * * *